US009427057B2

(12) United States Patent
Fenton et al.

(10) Patent No.: US 9,427,057 B2
(45) Date of Patent: Aug. 30, 2016

(54) PORTABLE ELECTRONIC DEVICE CASE

(71) Applicant: Fairhaven Group, Inc., Seattle, WA (US)

(72) Inventors: Timothy John Fenton, Mercer Island, WA (US); Gary Allen Ashley, Seattle, WA (US)

(73) Assignee: Fairhaven Group, Inc., Seattle, WA (US)

( * ) Notice: Subject to any disclaimer, the term of this patent is extended or adjusted under 35 U.S.C. 154(b) by 52 days.

(21) Appl. No.: 14/599,742

(22) Filed: Jan. 19, 2015

(65) Prior Publication Data

US 2016/0206063 A1 Jul. 21, 2016

(51) Int. Cl.
*B65D 85/00* (2006.01)
*A45C 11/00* (2006.01)

(52) U.S. Cl.
CPC ..... *A45C 11/00* (2013.01); *A45C 2011/003* (2013.01)

(58) Field of Classification Search
USPC ..... 206/320, 460, 472, 473
See application file for complete search history.

(56) References Cited

U.S. PATENT DOCUMENTS 5,175,876 A * 12/1992 Villacis Mendoza ..... H01H 9/0242 206/320
2010/0078343 A1* 4/2010 Hoellwarth ..... B29C 45/14639 206/320
2012/0118770 A1* 5/2012 Valls ..... F16M 11/10 206/320
2013/0032432 A1* 2/2013 Slotta ..... H05K 5/02 181/199
2014/0197048 A1* 7/2014 Napolitano ..... H05K 5/0226 206/45.2
2014/0216971 A1* 8/2014 Ashley ..... A45C 11/00 206/472

* cited by examiner

*Primary Examiner* — Jacob K Ackun

(57) ABSTRACT

Systems and methods are involved with but are not limited to: a first case portion including a first interior portion, the first interior portion including a first layer and a plurality of first protrusions, the plurality of first protrusions coupled to the first layer and extending therefrom, the plurality of first protrusions configured to affixedly engage with one or more smooth surface portions of a rear side portion of a portable device keyboard assembly. In addition to the foregoing, other method aspects are described in the claims, drawings, and text forming a part of the present disclosure.

20 Claims, 6 Drawing Sheets

PORTABLE ELECTRONIC DEVICE CASE

SUMMARY

In one aspect, an apparatus includes, but is not limited to a first case portion including a first interior portion, the first interior portion including a first surface and a plurality of first protrusions, the plurality of first protrusions extending from the first surface of the first interior portion, the plurality of first protrusions configured to affixedly engage with one or more smooth surface portions of a rear side portion of a portable device keyboard portion. In addition to the foregoing, other method aspects are described in the claims, drawings, and text forming a part of the disclosure set forth herein.

In addition to the foregoing, various other aspects are set forth and described in the teachings such as text (e.g., claims and/or detailed description) and/or drawings of the present disclosure. The foregoing is a summary and thus may contain simplifications, generalizations, inclusions, and/or omissions of detail; consequently, those skilled in the art will appreciate that the summary is illustrative only and is NOT intended to be in any way limiting. Other aspects, features, and advantages of the devices and/or processes and/or other subject matter described herein will become apparent in the teachings set forth herein.

BRIEF DESCRIPTION OF THE FIGURES

For a more complete understanding of embodiments, reference now is made to the following descriptions taken in connection with the accompanying drawings.

The use of the same symbols in different drawings typically indicates similar or identical items, unless context dictates otherwise.

With reference now to the figures, shown are one or more examples of disparate material outsole based articles of manufacture, compositions of matter, systems for producing and/or methods for producing same that may provide context, for instance, in introducing one or more processes and/or devices described herein.

Figure 1:
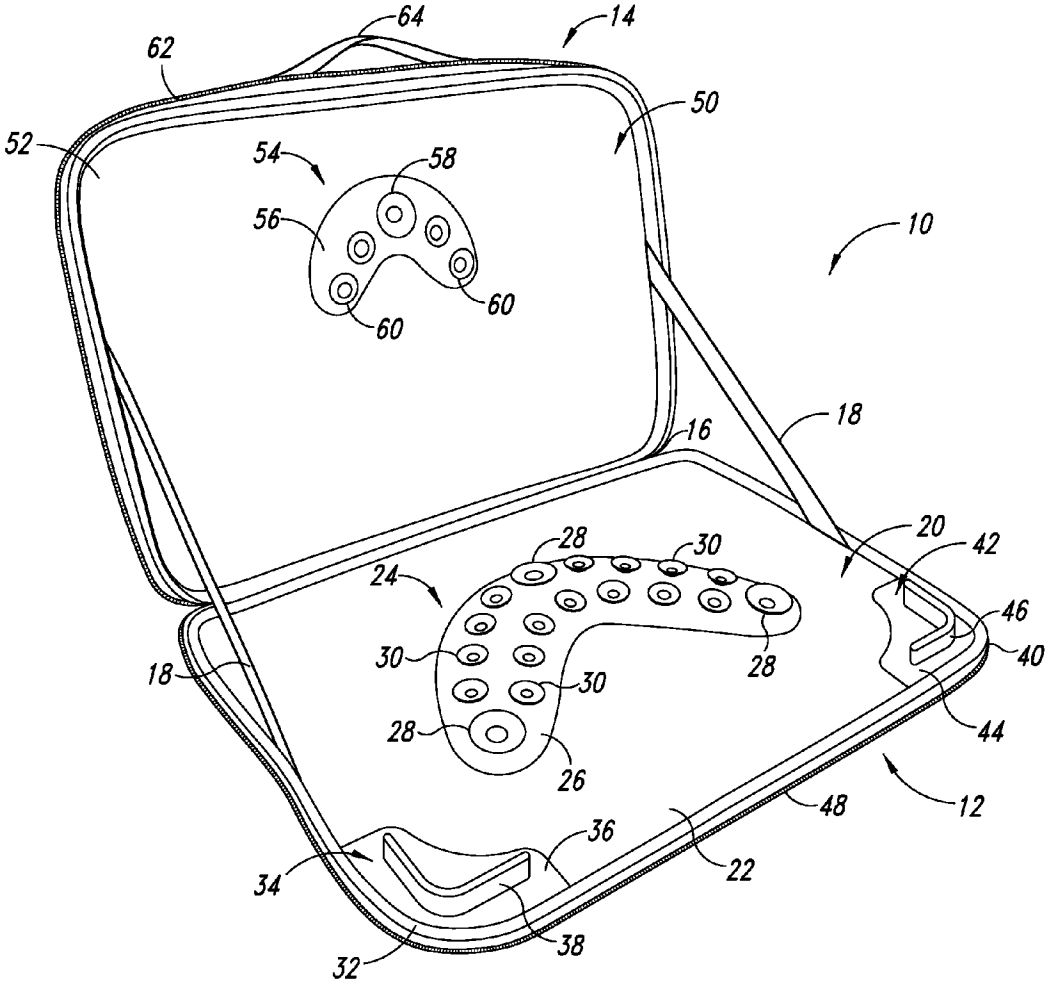

FIG. 1 is a perspective view of a portable electronic device case shown as opened up in an open disposition with exemplary embodiment depicted for a portable electronic device as a laptop computer.

Figure 2:
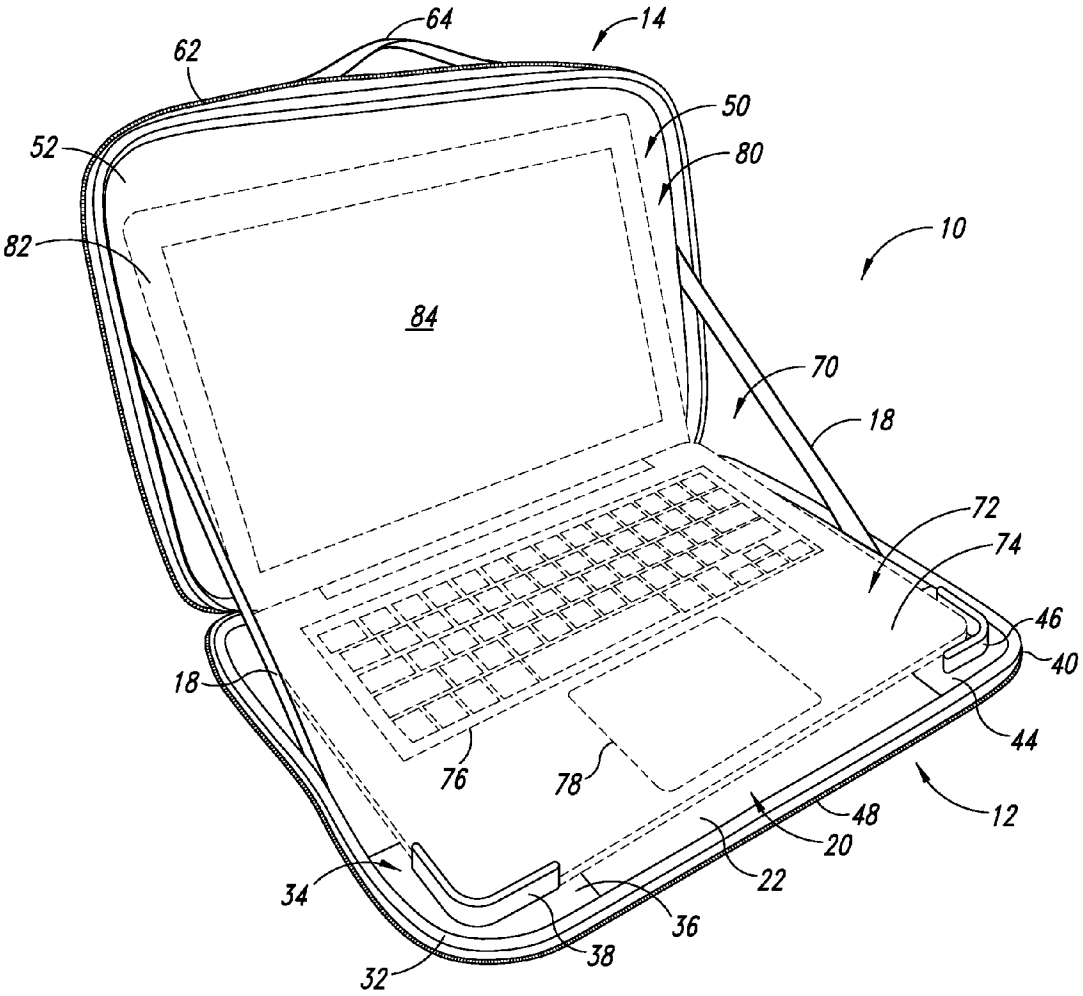

FIG. 2 is a perspective view of the portable electronic device case of FIG. 1 shown as opened up in an open disposition containing an exemplary portable electronic device as a laptop computer.

Figure 3:
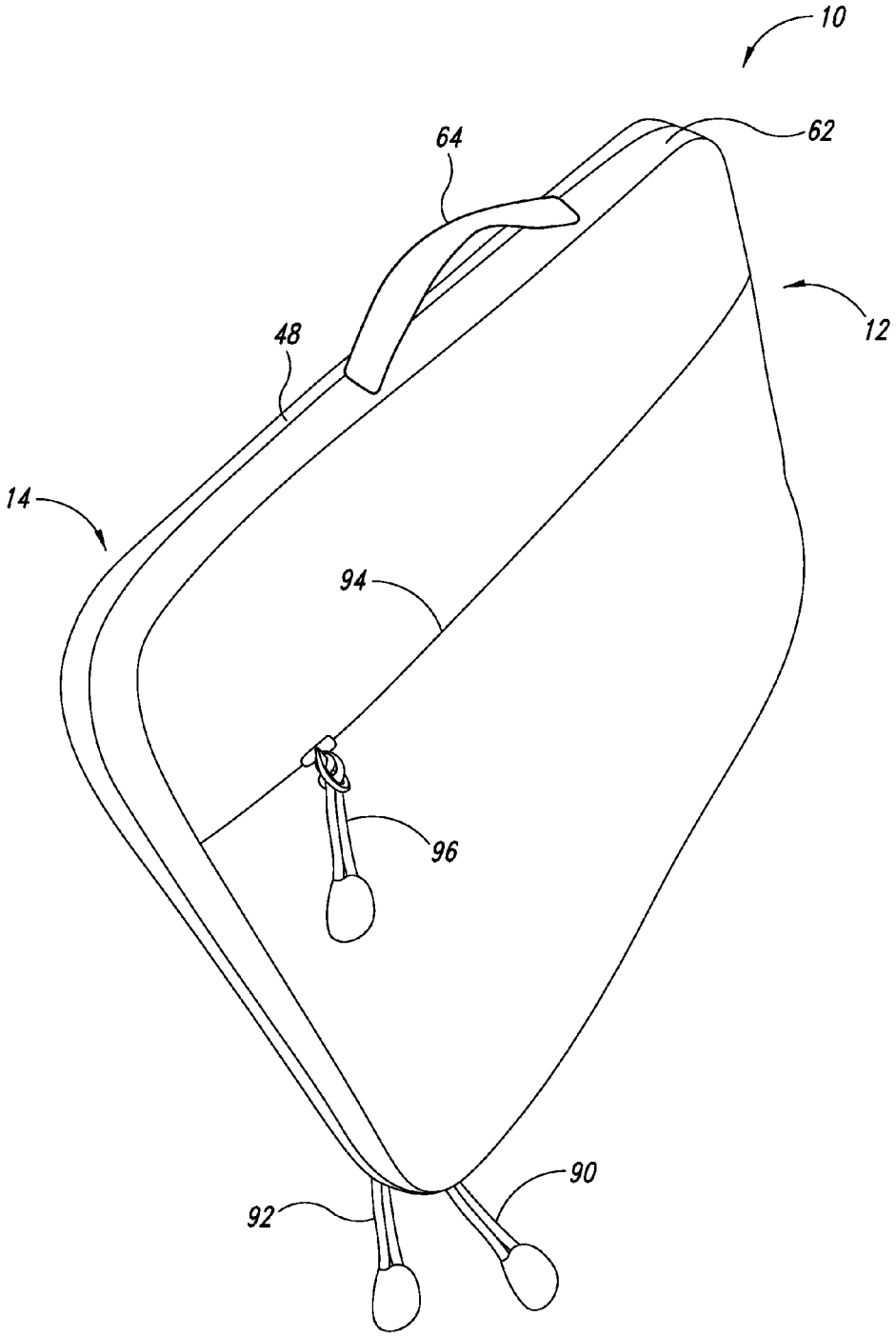

FIG. 3 is a perspective view of the portable electronic device case of FIG. 1 shown as closed up in a closed disposition.

Figure 4A:
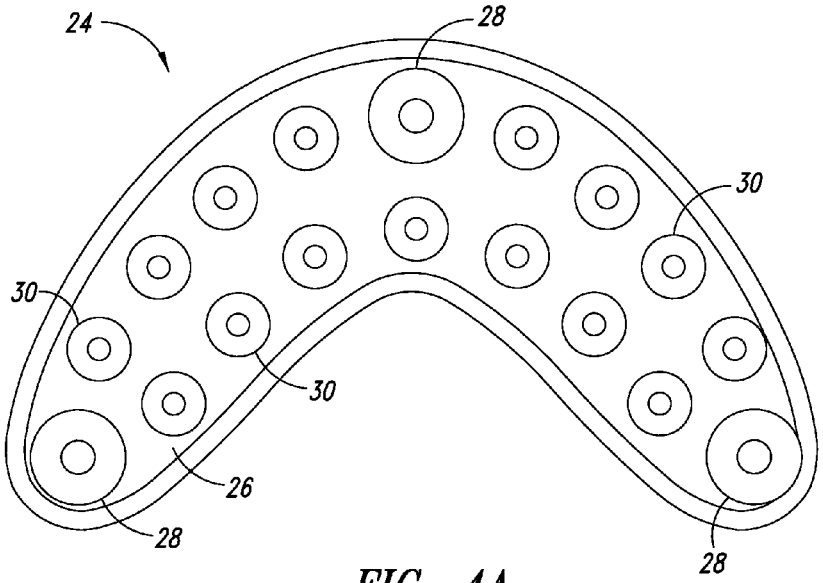

FIG. 4A is a top plan view of a first protrusion assembly of the portable electronic device case of FIG. 1, the first protrusion assembly depicted as containing suction cup protrusions.

Figure 4B:
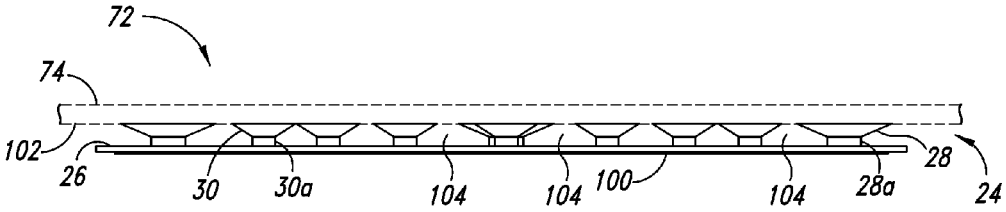

FIG. 4B is a side elevational view of the first protrusion assembly of FIG. 4A.

Figure 4C:
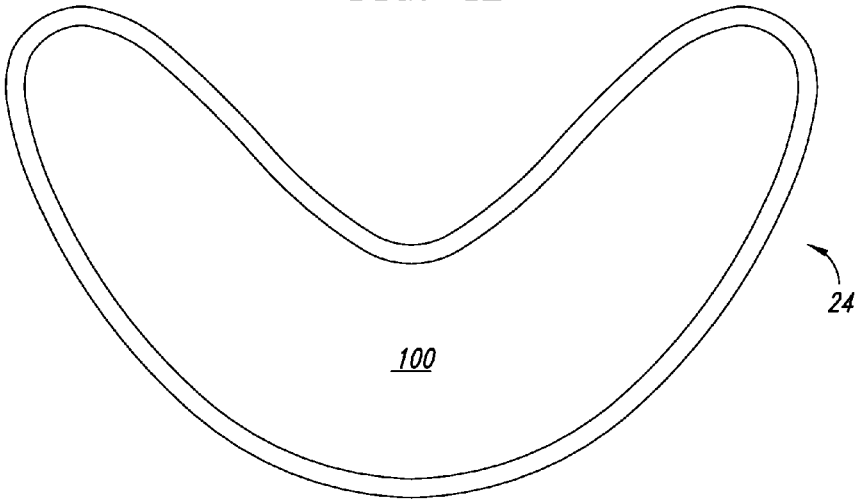

FIG. 4C is a bottom plan view of the first protrusion assembly of FIG. 4A.

Figure 5A:
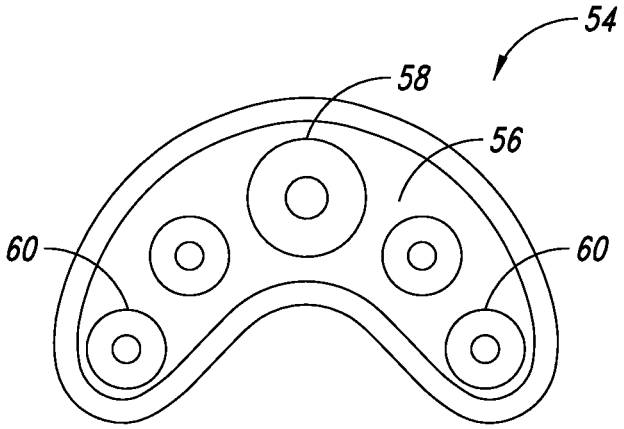

FIG. 5A is a top plan view of a second protrusion assembly of the portable electronic device case of FIG. 1, the second protrusion assembly depicted as containing suction cup protrusions.

Figure 5B:
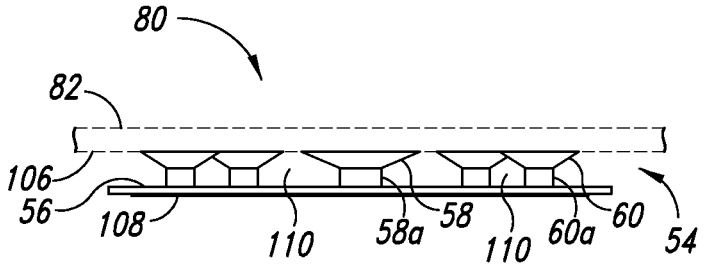

FIG. 5B is a side elevational view of the second protrusion assembly of FIG. 5A.

Figure 5C:
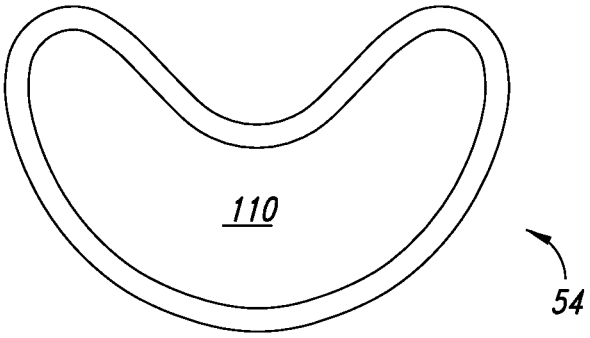

FIG. 5C is a bottom plan view of the second protrusion assembly of FIG. 5A.

Figure 6A:
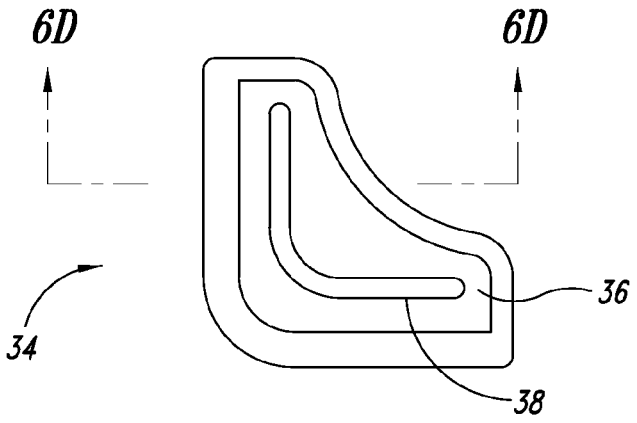

FIG. 6A is a top plan view of a first corner guard assembly of the portable electronic device case of FIG. 1.

Figure 6D:
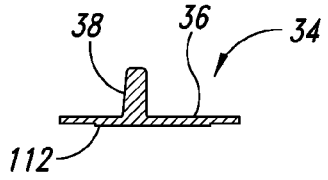
Figure 6B:
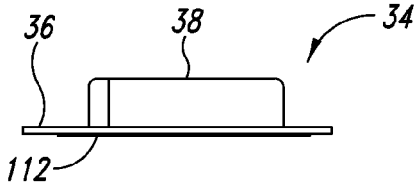

FIG. 6B is a side elevational view of the first corner guard assembly of FIG. 6A and FIG. 6D is another view of the first corner guard assembly.

Figure 6C:
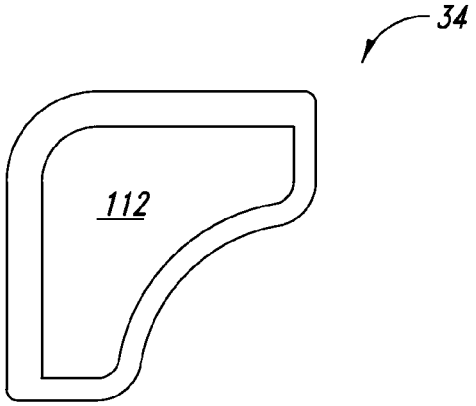

FIG. 6C is a bottom plan view of the first corner guard assembly of FIG. 6A.

FIG. 6D is a cross-sectional side elevational view along cut-line 6D-6D of the first corner guard assembly of FIG. 6A.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Conventional cases for portable electronic devices can use straps and other securing means that can cause obstructions and be visually and tactilely displeasing. Furthermore, use of cases that are always affixed to devices can cause unwanted heat buildup during device operation.

Referring now to FIG. 1, portable device case 10 is depicted as opened up in an open disposition and as having first case portion 12 and second case portion 14 with flexible hinge-like portion 16 positioned there betwixt to allow for axially oriented motion of the first case portion 12 and the second case portion 14 relative therebetween. The portable device case 10 also includes first and second support strap 18 to provide further support between the first case portion 12 and the second case portion 14.

The first case portion 12 includes first interior 20 further including first layer 22 and first protrusion assembly 24. The first layer 22 can be made from a fabric or other flexible material. The first protrusion assembly 24 can be a single molded piece and includes first protrusion base member 26 with first sized protrusion 28 and second sized protrusion 30 extending therefrom. The first sized protrusion 28 and the second sized protrusion 30 can be made from a high grade silicone or other similarly deformable material and are depicted as variously sized suction cups in the exemplary implementation. The first interior 20 further includes first case corner 32 and first corner guard assembly 34 located therein. The first corner guard assembly 34 includes first corner base member 36 and first corner guard member 38, which can be a single piece molded from a high grade silicone or other resilient material. In addition, the first interior 20 further includes second case corner 40 and second corner guard assembly 42 located therein. The second corner guard assembly 42 includes second corner base member 44 and second corner guard member 46, which can also be molded from a high grade silicone or other resilient material. The first corner guard member 38 and second corner guard member 46 of the first corner guard assembly 34 and the second corner guard assembly 42, respectively, with their perpendicularly oriented wall portions form corner-shaped supports to engage with device housing corners to help secure a contained portable electronic device such as a laptop to prevent sliding of such therein or accidental ejection of such there out.

The second case portion 14 includes second interior 50, which includes second layer 52 and second protrusion assembly 54. The second layer 52 can be made from a fabric or other flexible material. The second protrusion assembly 54 includes second protrusion base member 56 with first sized protrusion 58 and second sized protrusion 60. The first sized protrusion 58 and the second sized protrusion 60 can be made from a high grade silicone or other similarly deformable material and are depicted as variously sized suction cups. Depicted locations of the second corner guard member 46 and the second corner guard member 46 are exemplary such that other positions can be selected for instance to avoid unsmooth surface engagement (such as device feet or vents) with the first sized protrusion 28, second sized protrusion 30, first sized protrusion 58, and second sized protrusion 60. Also the first sized protrusion 28, second sized protrusion 30, first sized protrusion 58, and second sized protrusion 60 can include more variations in size such as more variation in size of suction cups.

As depicted in FIG. 2, the portable device case 10 is shown as opened up in an open disposition and as containing a portable electronic device 70 depicted as a laptop computer. The exemplary portable electronic device 70 is shown as having portable device keyboard assembly 72 including keyboard assembly front side portion 74, keyboard surface portion 76, and touch pad surface portion 78. The exemplary portable electronic device 70 is also shown as having portable device display assembly 80 including display assembly front side portion 82 and display surface portion 84.

Referring now to FIG. 3, depicted therein is the portable device case 10 as closed up in a closed disposition with the first zipper portion 48 and the second zipper portion 62 mated together in a zippered disposition. In addition, the portable device case 10 is shown as having zipper handle 90, zipper handle 92, zipper 94, and zipper handle 96 as well. Alternatively, the portable device case 10 could employ fastening means other than zipper mechanisms such as snaps, buckles, Velcro flaps, etc.

Further depicted in FIGS. 4A, 4B, and 4C is the first protrusion assembly 24 shown in FIG. 4B as including back side of first protrusion base member 100, which can be affixed to the first layer 22 of the first interior 20 by adhesive, sewing (such around a periphery of the first protrusion base member 26), stapling, bolting, slotted engagements, slide-lock into rigid connection, etc. The back side of first protrusion base member 100 can be other shapes and sizes such as rectangular as a rectangular shape and can also be further affixed to other structural layers such as one or more fabric, foam, plastic, rigid board panels, that can make up additional internal layers of the first case portion 12 to reduce flexing movement of the first sized protrusion 28 and the second sized protrusion 30, such as depicted as suction cups. The first protrusion assembly 24 is further shown with its first sized protrusion 28 and second sized protrusion 30 fixedly engaged with a smooth surface portion of keyboard assembly rear side portion 102 of the portable device keyboard assembly 72. The first sized protrusion 28 and the second sized protrusion 30 are further shown as having support stem 28*a* and support stem 30*a*, respectively, both extending from the first protrusion base member 26 of the first protrusion assembly 24. The support stem 28*a* and the support stem 30*a* further extend the keyboard assembly rear side portion 102 of the portable device keyboard assembly 72 away from the first protrusion base member 26 thereby creating air gap 104, which can aid in cooling of the portable electronic device 70.

Further depicted in FIGS. 5A, 5B, and 5C is the second protrusion assembly 54 shown in FIG. 5B as including air gap 110, which can be affixed to the second layer 52 of the second interior 50 by adhesive, sewing (such around a periphery of the second protrusion base member 56), stapling, bolting, slotted engagements, slide-lock into rigid connection, etc. The second protrusion base member back side 108 can be other shapes and sizes such as rectangular as a rectangular shape and can also be further affixed to other structural layers such as one or more fabric, foam, plastic, one or more rigid board panels that can make up additional internal layers of the second case portion 14 to reduce flexing movement of the first sized protrusion 58 and the second sized protrusion 60, such as depicted as suction cups. The second protrusion assembly 54 is further shown with its first sized protrusion 58 and second sized protrusion 60 fixedly engaged with a smooth surface portion of display assembly rear side portion 106 of the portable device display assembly 80. The first sized protrusion 58 and the second sized protrusion 60 are further shown as having support stem 58*a* and support stem 60*a*, respectively, both extending from the second protrusion base member 56 of the second protrusion assembly 54. The support stem 58*a* and the support stem 60*a* further extend the display assembly rear side portion 106 of the portable device display assembly 80 away from the second protrusion base member 56 of the second protrusion assembly 54 thereby creating air gap 110, which can aid in cooling of the portable electronic device 70.

Further depicted in FIGS. 6A, 6B, 6C, and 6D is the first corner guard assembly 34 shown in FIG. 6B as including first corner guard member back side 112, which can be affixed to the first layer 22 of the first interior 20 by adhesive, sewing, stapling, bolting, slotted engagements, etc.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

What is claimed is:

1. A portable electronic device case comprising:

a first case portion including a first interior portion, the first interior portion including a first layer and a plurality of first protrusions, the plurality of first protrusions coupled to the first layer and extending therefrom, the plurality of first protrusions configured to affixedly engage with one or more smooth surface portions of a rear side portion of a portable device keyboard assembly; and a second case portion including a second interior portion, the second interior portion including a second layer and a plurality of second protrusions, the plurality of second protrusions coupled to the second layer and extending therefrom, the second protrusions configured to affixedly engage with one or more smooth surface portions of a rear side portion of a portable device display assembly.

2. The portable electronic device case of claim 1 wherein the plurality of first protrusions and the plurality of second protrusions comprise suction cups.

3. The portable electronic device case of claim 1 wherein the plurality of first protrusions and the plurality of second protrusions comprise silicone material.

4. The portable electronic device case of claim 1 wherein the first interior portion further comprises a first base member and a second base member, the first protrusions including first support stems and first suction cups coupled thereto and extending therefrom, the first support stems coupled to and extending from the first base, the first base coupled to the first layer, the second protrusions including seond support stems and second suction cups coupled thereto and extending therefrom, the second support stems being coupled to and extending from the second base, the second base coupled to the second layer.

5. The portable electronic device case of claim 4 wherein the first suction cups, the first support stems, and the first base member are a continuously formed single piece first protrusion assembly and wherein the second suction cups, the second support stems, and the second base member are a continuously formed single piece second protrusion assembly.

6. The portable electronic device case of claim 5 wherein the first and second protrusion assemblies being silicone material.

7. The portable electronic device case of claim 4 wherein the first base member being sewn to the first layer of the first interior portion and the second base member being sewn to the second layer of the second interior portion.

8. The portable electronic device case of claim 1 wherein the plurality of first protrusions extend from the first layer of the first interior portion to form one or more air gaps when the plurality of first protrusions affixedly engage with one or more smooth surface portions.

9. The portable electronic device case of claim 1 further comprising a corner guard assembly including a corner base member and a corner guard member, the corner base member coupled to the first layer, the corner guard member coupled to and extending from the corner base member, the corner guard member including perpendicularly oriented first and second wall portions forming a corner-shaped support, the corner guard assembly positioned to allow for frictional engagement of a corner of portable electronic device so positioned in the first interior portion of the first case portion.

10. The portable electronic device case of claim 1 wherein the first case portion and the second case portion are hingedly coupled together.

11. The portable electronic device case of claim 1 wherein the first case portion and the second case portion are coupled together via a flexible hinge portion.

12. A portable electronic device case comprising:

a first case portion including a first interior portion, the first interior portion including a first protrusion assembly, the first protrusion assembly including a first base member, a plurality of first support stems, and a plurality of first suction cups, the plurality of first support stems coupled to and extending from the first base member, the plurality of first suction cups coupled to and extending from the first support stems.

13. The portable electronic device case of claim 12 further comprising:

a second case portion including a second interior portion, the second interior portion including a second protrusion assembly, the second protrusion assembly including a second base member, a plurality of second support stems, and a plurality of second suction cups, the plurality of second support stems coupled to and extending from the second base member, the plurality of second suction cups coupled to and extending from the second support stems.

14. The portable electronic device case of claim 12 wherein the first protrusion assembly comprises a silicone material.

15. The portable electronic device case of claim 12 wherein the first protrusion assembly being a single formed piece.

16. The portable electronic device case of claim 12 wherein the first interior portion further comprises a first layer, the first base member being sewn to the first layer.

17. The portable electronic device case of claim 12 wherein the first interior portion further comprises a first corner guard assembly including a first corner guard member and a first corner base member, the first corner guard member including perpendicularly oriented first and second wall portions coupled to and extending from the first corner base member and forming a corner-shaped support.

18. The portable electronic device case of claim 13 wherein the first case portion and the second case portion are hingedly coupled together.

19. The portable electronic device case of claim 13 wherein the first case portion and the second case portion are coupled together via a flexible hinge portion.

20. A portable electronic device case comprising:

a first case portion including means for affixedly engaging with one or more smooth surface portions of a keyboard assembly rear side portion; and a second case portion including means for affixedly engaging with one or more smooth surface portions of a display assembly rear side portion.

* * * * *